US011187386B2

(12) United States Patent
Van Bommel et al.

(10) Patent No.: US 11,187,386 B2
(45) Date of Patent: Nov. 30, 2021

(54) LED FILAMENT LAMP

(71) Applicant: SIGNIFY HOLDING B.V., Eindhoven (NL)

(72) Inventors: Ties Van Bommel, Eindhoven (NL); Rifat Ata Mustafa Hikmet, Eindhoven (NL); Robert Jacob Pet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/259,941

(22) PCT Filed: Jul. 9, 2019

(86) PCT No.: PCT/EP2019/068398

§ 371 (c)(1),
(2) Date: Jan. 13, 2021

(87) PCT Pub. No.: WO2020/016058

PCT Pub. Date: Jan. 23, 2020

(65) Prior Publication Data

US 2021/0310617 A1 Oct. 7, 2021

(30) Foreign Application Priority Data

Jul. 16, 2018 (EP) ..... 18183604

(51) Int. Cl.
*F21S 10/04* (2006.01)
*F21K 9/232* (2016.01)
(Continued)

(52) U.S. Cl.
CPC ..... *F21K 9/232* (2016.08); *F21K 9/68* (2016.08); *F21Y 2113/17* (2016.08); *F21Y 2115/10* (2016.08)

(58) Field of Classification Search
None
See application file for complete search history.

(56) References Cited

U.S. PATENT DOCUMENTS

2012/0217862 A1 8/2012 Matsuda
2016/0116120 A1 4/2016 Kwisthout

FOREIGN PATENT DOCUMENTS

CN 204153512 U 2/2015
CN 205208156 U 5/2016
(Continued)

*Primary Examiner* — Elmito Breval
(74) *Attorney, Agent, or Firm* — Daniel J. Piotrowski

(57) ABSTRACT

There is provided a light emitting diode, LED, filament lamp (100) which provides LED filament lamp light (101). The LED filament lamp comprises at least one LED filament (102), at least one further LED (105), an at least partly transmissive envelope (107), and an optical element (108). The at least one LED filament (102) comprises a carrier (103) which has an elongated body and a plurality of LEDs (104) mechanically coupled to the carrier (103). The at least one LED filament (102) is configured to emit LED filament light (104'). The LED filament light (104') has a first spectral distribution SI with a first color point x1,y1 and a first correlated color temperature T1. The at least one further LED (105) is configured to emit further LED light (106) which has a second spectral distribution S2 with a second color point x2,y2. The at least one LED filament (102) and the at least one further LED (105) are at least partly enclosed by the at least partly transmissive envelope (107). The optical element (108) is arranged to collimate the further LED light (106) into collimated further LED light (109). The LED filament lamp light (101) is composed of the LED filament light (104') which has a first spatial distribution (S'1) and the collimated further LED light (109) which has a second spatial distribution (S'2). The first spatial distribution (S'1) is broader than the second spatial distribution
(Continued)

(S'2). The first spectral distribution SI and the second spectral distribution S2 arc different and wherein one or more of (i) x1/x2>1.1, and (ii) x1/x2>1.1 and y1/y2>1.1 with x1/x2>y1/y2 applies.

15 Claims, 10 Drawing Sheets

(51) Int. Cl.

| | |
|---|---|
| ***F21K 9/68*** | (2016.01) |
| *F21Y 113/17* | (2016.01) |
| *F21Y 115/10* | (2016.01) |

(56) References Cited

FOREIGN PATENT DOCUMENTS

| | | | |
|---|---|---|---|
| CN | 205402603 | U | 7/2016 |
| CN | 206176271 | U | 5/2017 |
| GB | 2539190 | A | 12/2016 |
| GN | 202132734 | U | 2/2012 |
| JP | 2016021314 | A | 2/2016 |
| WO | 2017042323 | A1 | 3/2017 |
| WO | 2018041826 | A1 | 3/2018 |

LED FILAMENT LAMP

CROSS-REFERENCE TO PRIOR APPLICATIONS

This application is the U.S. National Phase application under 35 U.S.C. § 371 of International Application No. PCT/EP2019/068398, filed on Jul. 9, 2019, which claims the benefit European Patent Application No. 18183604.0, filed on Jul. 16, 2018. These applications are hereby incorporated by reference herein.

FIELD OF THE INVENTION

The present invention generally relates to a light emitting diode (LED) filament lamp. The present invention further relates to a luminaire comprising said LED filament lamp.

BACKGROUND OF THE INVENTION

Incandescent lamps are rapidly being replaced by LED based lighting solutions. It is nevertheless appreciated and desired by users to have retrofit lamps which have the look of an incandescent lamp. For this purpose, one can simply make use of the infrastructure for producing incandescent lamps based on a (glass) envelope and replace the filament with LEDs emitting white light. One of the concepts is based on LED filaments placed in such an envelope. The appearances of these lamps are highly appreciated as they look highly decorative.

One of such LED based solutions is known from US 2012/0217862 A1, describing a lamp comprising a LED module having a translucent board in the shape of a plate and a plurality of LEDs mounted on the board such as to form two lines of LEDs. The LED module further comprises a sealing component for sealing the LEDs such that the lines of LEDs, when in operation, give the impression of a filament. The LED module further comprises lines, wiring and power supply for the LEDs.

In order to improve the nostalgic or vintage look of LED filament lamps, the LED filaments of filament lamps typically provide warm white light i.e. light of a very low color temperature. The color temperature is typically below 2700 K such as for example 2500 K or 2300 K. Some LED filaments lamps provide light of an ultra-low color temperature such as for example 2200 K or 2000 K. A low color temperature source will look yellowish or reddish, which is appreciated. However, a drawback of this solution is that when using these LED filament lamps for general illumination purposes color recognition is unsatisfactory.

US 2016/116120 A1 discloses a lighting device for providing decorative lighting. In one embodiment, the lighting device comprises a base, said base comprises a base for retro-fitting a traditional incandescent light bulb, a continuous optical element in which a string of a plurality of light emitting diodes is arranged, and an envelope encapsulating said continuous optical element such that the lighting device resembles a traditional incandescent light bulb.

CN 202 132 734 U discloses a LED lamp bulb with a high color rendering index and a high efficiency, which comprises a light transmission bulb shell, a core column having an exhaust pipe, an electric outgoing line, a metal wire for fixing and a bracket, at least two LED light-emitting bars, a driver, an electric connector and a connecting member for the electric connector and the bulb shell. The bulb shell and the core column are vacuum-sealed, and gas having a high heat conducting coefficient and a low viscosity is filled in the bulb shell; the LED light-emitting bars are fixed on the core column, the electrodes of the LED light-emitting bars are connected with the driver and the electric connector by the electric outgoing line of the core column; the at least two LED light-emitting bars are two light-emitting bars having two different light-emitting colors, one is at least one white-light LED light-emitting bar having 4phi outlet light, and the other one is at least one LED light-emitting bar having other light-emitting colors; the latter one is manufactured by red and orange LED chips having a high efficiency or lamp beads, and used for changing the light-emitting color temperature and the color rendering index of the whole lamp; the relative light flux of the two light-emitting bars is regulated so that the color temperature and the color rendering index of the LED lamp bulb can be changed while the light-emitting efficiency of the whole lamp is not reduced remarkably, thus the high-efficiency white-light LED lamp bulb having different color temperatures and the high-efficiency LED lamp bulb having high color rendering index can be manufactured.

JP 2016 021314 A discloses an LED lamp includes: a case; a first light emitting module and a second light emitting module serving as light sources; a reflector; a globe having a light diffusing property; a circuit unit; and a base. The reflector is fitted into an opening at a front end of the globe, and reflects the light from the first light emitting module and focuses it to the front. The light from the second light emitting module is diffused by the globe and emitted radially to the periphery of the focused light.

SUMMARY OF THE INVENTION

It is an object of the present invention to provide a LED filament lamp in which a drawback of the known LED filament lamp is counteracted.

The present invention discloses a LED filament lamp in accordance with the independent claim 1. Preferred embodiments are defined by the dependent claims.

According to a first aspect of the invention, a LED filament lamp is provided which provides LED filament lamp light and comprises at least one LED filament, at least one further LED, an at least partly transmissive envelope, and an optical element. The at least one LED filament comprises a carrier which has an elongated body and a plurality of LEDs mechanically coupled to the carrier. The at least one LED filament is configured to emit LED filament light. The LED filament light has a first spectral distribution S1 with a first color point x1,y1 (CIE coordinates (especially CIE 1931 color space chromaticity)) and a first correlated color temperature T1. The at least one further LED is configured to emit further LED light which has a second spectral distribution S2 with a second color point x2,y2. The at least one LED filament and the at least one further LED are at least partly enclosed by the at least partly transmissive envelope. The optical element is arranged to collimate the further LED light into collimated further LED light. The LED filament lamp light is composed of the LED filament light which has a first spatial distribution S'1 and the collimated further LED light which has a second spatial distribution S'2. The first spatial distribution S'1 is broader than the second spatial distribution S'2. The first spectral distribution S1 and the second spectral distribution S2 are different. One or more of (i) $x1/x2 \geq 1.1$, and (ii) $x1/x2 \geq 1.1$ and $y1/y2 \geq 1.1$ with $x1/x2 \geq y1/y2$ applies.

Hence the invention provides a LED filament lamp that is able to provide decorative lighting with improved visibility of objects and colors. The reason is that instead of a LED filament lamp providing (decorative) (ultra) warm white light, a LED filament lamp is used which provides LED filament light which is composed of the (decorative) LED filament light having a first spatial distribution S'1 and the (functional) collimated further LED light having a second spatial distribution S'2, wherein the first spatial distribution S'1 is broader than the second spatial distribution S'2, wherein the first spectral distribution S1 and the second spectral distribution S2 are different; and wherein one or more of (i) $x1/x2 \geq 1.1$, and (ii) $x1/x2 \geq 1.1$ and $y1/y2 \geq 1.1$ with $x1/x2 \geq y1/y2$ applies. Since the LED filament lamp light is composed of collimated (functional) further LED light and decorative-ambient LED filament light, the LED filament will have a nostalgic or vintage look (i.e. yellowish or reddish) and objects and colors illuminated with the (additional) functional are better visible.

A LED filament lamp, for example, disclosed in US 2012/0217862 A1 is unable to provide decorative lighting with improved visibility of objects and colors. The reason is that the decorative (ultra) warm white light emitted from these LED filament lamps does not provide satisfactory color recognition of objects and colors.

Each spectral distribution has an accompanying color point x, y (CIE coordinates (especially CIE 1931 color space chromaticity)). These are herein indicated as x1,y1 as the color point for the first spectral distribution S1 and as x2,y2 as the color point for the second spectral distribution S2.

The LED filament lamp might have the feature wherein $x1/x2 \geq 1.2$ applies. More preferably, the LED filament lamp might have the feature wherein $x1/x2 \geq 1.3$ applies. More preferably, the LED filament lamp might have the feature wherein $x1/x2 \geq 1.4$ applies. The obtained effect is decorative lighting of the at least one LED filament with further improved visibility of objects and colors by the contribution of collimated further LED light. The reason is that a higher difference between x1 and x2 results in a better contrast between both lighting effects i.e. decorative lighting and functional lighting.

The collimated further LED light may preferably have a full-width-half-max (FWHM) of less than 50 degrees. More preferably, the collimated further LED light may preferably have a FWHM of less than 45 degrees. Most preferably, the collimated further LED light may preferably have a FWHM of less than 40 degrees such as for example 30 or 25 degrees. The obtained effect is improved functional lighting i.e. improved visibility of objects and colors. The reason is that light is better collimated. When the same further LED is used, the beam angle (FWHM) of the collimated light typically determines the illuminance (lux) on the task area. The desired illuminance depends on the function to be performed at the task area, i.e. for general task as reading and writing an illuminance of about 300 lux is preferred, while drawing of fine detailed artwork an illuminance of about 600 lux is desired. Furthermore, an improved experience of the vintage look is attained with decreasing FWHM of the collimated functional lighting.

The LED filament lamp might have the feature wherein $1.5 \geq x1/x2 \geq 1.1$ and $1.5 \geq y1/y2 \geq 1.1$ with $x1/x2 \geq y1/y2$ applies. The obtained effect is decorative lighting of the at least one LED filament with further improved visibility of objects and colors by the contribution of collimated further LED light. The reason is that the further LED light is light having a higher color temperature than the LED filament light.

The LED filament lamp might have the feature that the further LED light has a second correlated color temperature T2, wherein $T1/T2 \leq 0.9$ applies. More preferably, $T1/T2 \leq 0.8$ applies. Most preferably, $T1/T2 \leq 0.7$ applies. The obtained effect is decorative lighting of the at least one LED filament with further improved visibility of objects and colors by the contribution of collimated further LED light. The reason is that a higher difference between T1 and T2 results in a better contrast between both lighting effects i.e. decorative lighting and functional lighting. Adding collimated further LED light which has a second correlated color temperature T2 to LED filament light which has a first correlated color temperature T1 results in combined light which has a correlated color temperature T3. The correlated color temperature T3 is located between correlated color temperature T1 and correlated color temperature T2 on the black body line (BBL) or close to the BBL.

The LED filament lamp might have the feature that the first color temperature T1 is lower than 2650 K and the second color temperature T2 is higher than 2950 K. More preferably, the first color temperature T1 is lower than 2550 K and the second color temperature T2 is higher than 3400 K. Most preferably, the first color temperature T1 is lower than 2500 K and the second color temperature T2 is higher than 3900 K. The obtained effect is decorative lighting of the at least one LED filament with further improved visibility of objects and colors by the contribution of collimated further LED light. The reason is that a higher difference between T1 and T2 results in a better contrast between both lighting effects i.e. decorative lighting and functional lighting.

The LED filament lamp might have the feature that the first color temperature T1 is preferably in the range of 1500 K to 2650 K. More preferably, the first color temperature T1 is preferably in the range of 1800 K to 2650 K. Most preferably, the first color temperature T1 is preferably in the range of 2000 K to 2650 K. The obtained effect is improved vintage look of the LED filament. These ranges are preferred by customers.

The LED filament lamp might have the feature that the second color temperature T2 is preferably in the range of 2950 K to 8000 K. More preferably, the second color temperature T2 is preferably in the range of 2950 K to 7000 K. Most preferably, the second color temperature T2 is preferably in the range of 2950 K to 6000 K. The obtained effect is further improved visibility of objects and colors by the contribution of collimated further LED light. The reason is that the further LED light is light having a higher color temperature than the LED filament light, but not a too high color temperature.

The LED filament lamp might have the feature that the further LED light has a (highest) dominant wavelength ($\lambda d$) in a range from 420 to 500 nm. The obtained effect is decorative lighting of the at least one LED filament with further improved visibility of objects and colors by the contribution of collimated further LED light. The reason is that by adding further LED light which has a dominant wavelength ($\lambda d$) in a range from 420 to 500 nm shift the correlated color temperature T1 to a correlated color temperature T4 on the black body line (BBL) or close to the BBL. The correlated color temperature T4 has a higher color temperature than the correlated color temperature T1.

The LED filament lamp might have the feature that the at least one LED filament is at least partly arranged outside said optical element. The at least one LED filament may be arranged outside said optical element. The obtained effect is improved decorative lighting. The reason is that the at least one LED filament is clearly visible. The at least one LED filament may be arranged partly outside said optical element. The obtained effect is a gradual change from decorative lighting and functional lighting. The reason is that part of the LED filament light is also collimated.

The LED filament lamp might have the feature that the at least one LED is arranged further inside a cavity formed by the optical element. The obtained effect is improved functional lighting. The reason is that more further LED light is collimated.

The LED filament lamp might have the feature that the optical element is a reflector. The obtained effect is improved functional lighting. The reason is that most of the further LED light is collimated.

The reflector may be highly reflective. The reflectivity is preferably at least 80%. The reflector may also be partially reflective, so that you can still see the filament through the aluminum. More preferably, the reflectivity is at least 85%. Most preferably, the reflectivity is at least 88% such as for example 90 or 92%. The obtained effect is improved efficiency. The reason is that light which propagates through the reflector is partly absorbed by the light absorbing component of the lamp envelope, hence the less light propagates through the reflector the less light is absorbed by the lamp envelope. The reflector is preferably not transmissive.

The reflectivity of the reflector is preferably specular reflective. The obtained effect is improved collimation. The reason is that specular reflective surfaces provides a better defined, i.e. less scattered, redirection of light.

The reflectivity of the reflector is preferably constant over the visible wavelength. The visible wavelength range is from 400 to 800 nm.

The LED filament lamp might have the feature that it further comprises a cap and a driver. The driver is electrically connected to the cap, and the at least one LED filament and the at least one further LED.

The LED filament lamp might have the feature that the reflector is arranged as a concave reflector on a part of the at least partly transmissive envelope. The obtained effect is improved decorative appearance of the LED filament lamp.

The LED filament lamp might have the feature that the reflector screens the at least one further LED at a screening angle $\alpha$ higher than 65 degrees with respect to the longitudinal axis of the LED filament lamp. More preferably, the reflector screens the at least one further LED at a screening angle $\alpha$ higher than 60 degrees with respect to the longitudinal axis of the LED filament lamp. Most preferably, the reflector screens the at least one further LED at a screening angle $\alpha$ higher than 55 degrees with respect to the longitudinal axis of the LED filament lamp. The obtained effect is reduced glare. The reason is that further LED light at higher angles is screened. The at least one LED filament is still visible at an angle $\alpha$ higher than 65 degrees with respect to the longitudinal axis of the LED filament lamp. This is required for providing decorative lighting and seeing the at least one LED filament of the LED lamp at larger angles. The longitudinal axis (LA) is the axis extending from the bottom of the LED filament lamp e.g. from the cap if the LED filament lamp to the top of the LED filament lamp.

The LED filament lamp might have the feature that the luminous flux of the at least one LED filament is lower than the luminous flux of the at least one further LED. More preferably, the luminous flux of the at least one further LED is at least 1.5 times the luminous flux of at least one LED filament. Most preferably, the luminous flux of the at least one further LED is at least 2 times the luminous flux of at least one LED filament. The obtained effect is improved functional lighting. The reason is that a higher luminous flux of the collimated further LED light results in better visibility of objects and colors.

The LED filament lamp comprises at least one lamp filament, the at least one lamp filament comprises the at least one LED filament and the at least one further LED. The obtained effect is improved assembly. The reason is that both light sources are integrated. There may be a gap or space between the at least one LED filament and the at least one further LED.

The LED filament lamp might have the feature that the at least one lamp filament comprises a base portion and a top portion. The base portion and the top portion are different, wherein the top portion comprises the at least one further LED and the base portion comprises the at least one LED filament, wherein the top portion is arranged more recessed inside the optical component than the base portion. The obtained effect is improved decorative lighting and functional lighting. The reason is that the further LED light is well collimated while the at least one LED filament is clearly visible.

The LED filament lamp may have the feature that the at least one LED filament comprises an encapsulant at least partially enclosing the plurality of LEDs, wherein the encapsulant comprises a first luminescent material. More preferably, the at least one LED filament comprises an encapsulant fully enclosing the plurality of LEDs, wherein the encapsulant comprises a first luminescent material. Most preferably, the at least one LED filament comprises an encapsulant fully enclosing the plurality of LEDs and the carrier, wherein the encapsulant comprises a first luminescent material. The obtained effect is improved decorative lighting. The reason is that LED light emitted by the plurality of LEDs is converted by the luminescent material into converted light. In this way the LED light and the converted light have the appearance of a single light source. The LED filament light comprises the LED light and/or converted light. The encapsulant may also be applied on the second major surface of the carrier i.e. on the first and second major surface of the encapsulant. The encapsulant on the second mayor surface may comprise the first luminescent material.

The plurality of LEDs may comprise colored LEDs e.g. UV and/or blue and/or green and/or red LEDs. For example, the plurality of LEDs may comprise blue, green and red LEDs.

The luminescent material may be a phosphor(s). The luminescent material may comprise green/yellow phosphor and/or a red phosphor.

The luminescent material may used in combination with UV and/or blue LEDs. UV and/or blue LEDs may emit UV and/or blue light. The UV and/or blue light is at least partly converted by the luminescent material into converted light. The converted light may be green/yellow and/or red light.

The LED filament lamp may comprise the feature that the at least one further LED comprises an encapsulant at least partially enclosing the at least one further LEDs, wherein the encapsulant comprises a second luminescent material, wherein the at least one of (i) the thickness, (ii) the concentration, and (iii) the type of the luminescent material of the first luminescent material and the second luminescent material are different with respect to the first luminescent material. The obtained effect is improved manufacturability. The reason is that both types of light source (i.e. the at least one LED filament and the at least one further LED) may be both covered by a luminescent material.

The LED filament lamp may further comprise a control unit electrically connected to the at least one LED filament and the at least one further LED to separately control the amount of LED filament light and (collimated) further LED light. The obtained effect is controllable decorative light with respect to the functional light. The reason is that both types of light can be adjusted by the control unit.

The present invention discloses a luminaire in accordance with claim 15. The luminaire might have the feature that the luminaire comprises the LED filament lamp. The obtained effect is that a luminaire with a vintage look is obtained. The reason is that the LED filament lamp may be visible through the light exit window of the luminaire.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

The same features having the same function in different figures are referred to the same references.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and convey the scope of the invention to the skilled person.

Figure 1A:
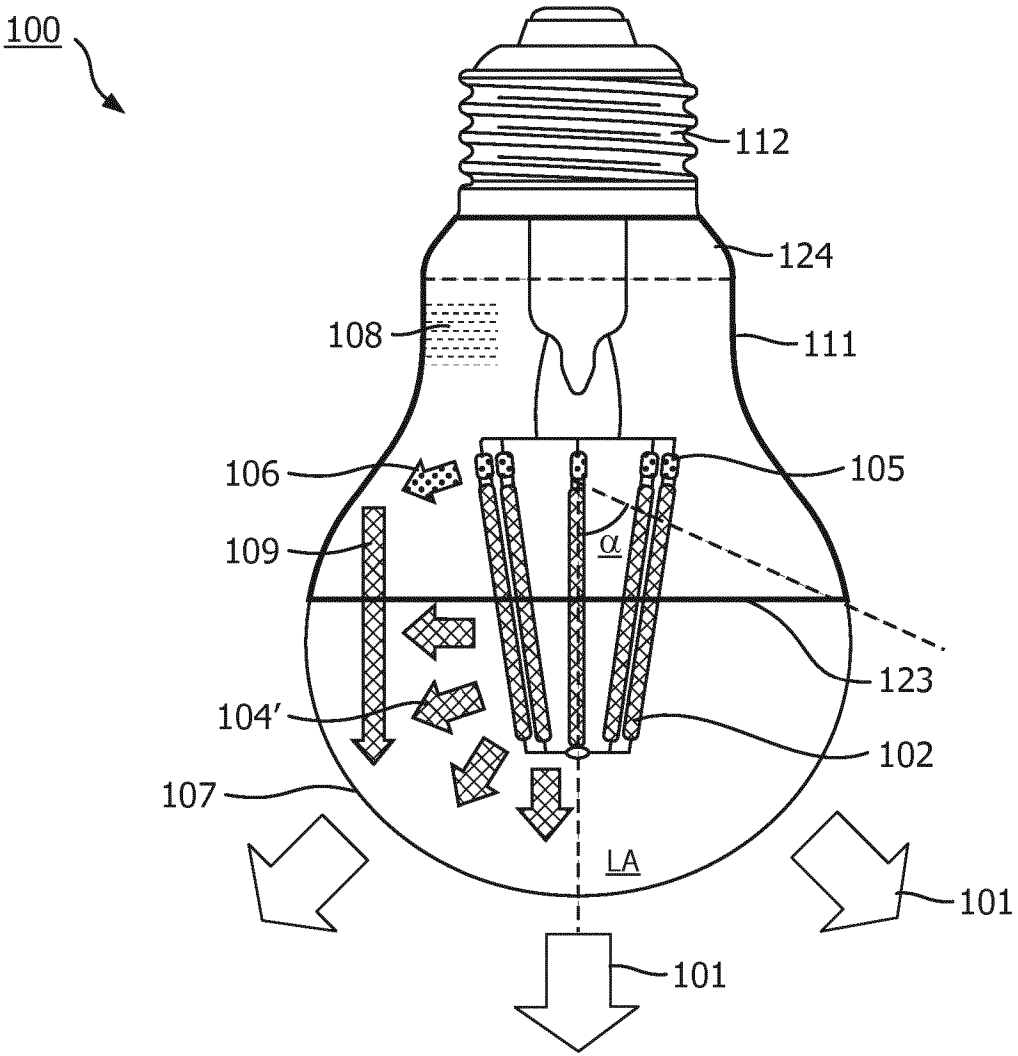
FIG. 1*a* shows a schematic view a LED filament lamp according to an embodiment of the present invention.
Figure 1D:
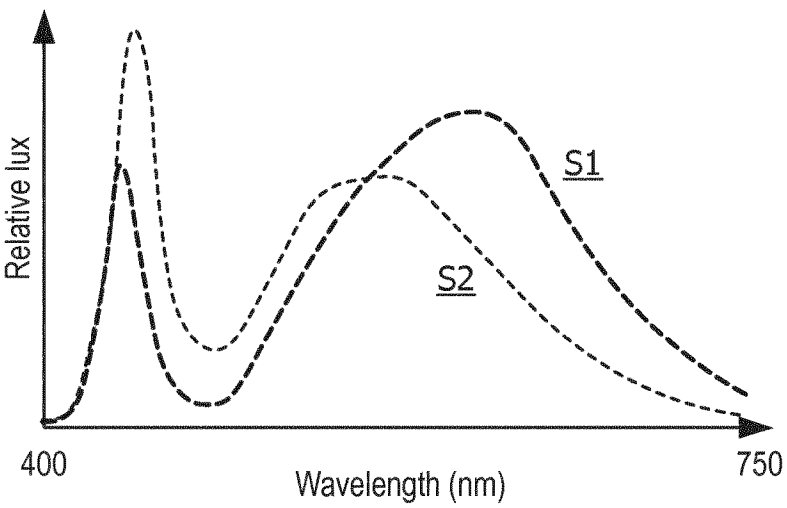
FIG. 1*d* shows a first spectral distribution and a second spectral distribution according to an embodiment of the present invention.
Figure 1C:
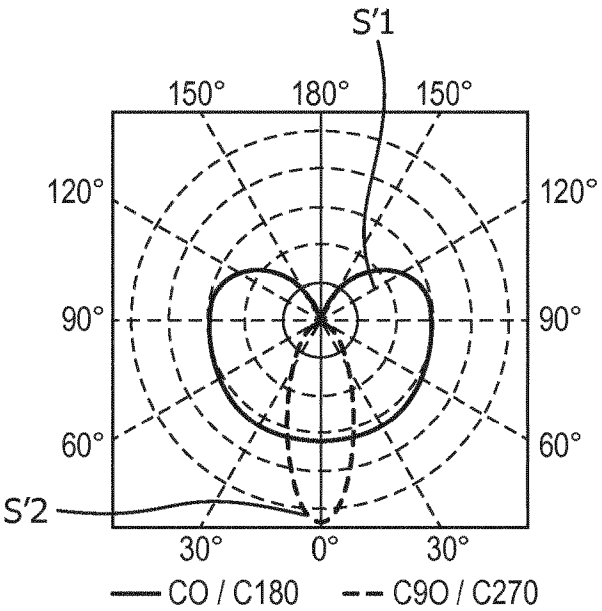
FIG. 1*c* shows a photometric distribution of the LED filament lamp light according to an embodiment of the present invention.
Figure 1B:
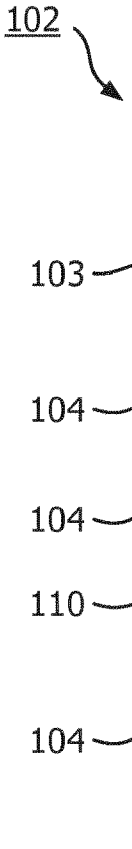
FIG. 1*b* shows a schematic view a LED filament according to an embodiment of the present invention.

FIG. 1*a* shows a schematic view a LED filament lamp according to an embodiment of the present invention. FIG. 1*b* shows a schematic view a LED filament according to an embodiment of the present invention. FIG. 1*c* shows a photometric distribution of the LED filament lamp light according to an embodiment of the present invention. FIG. 1*d* shows a first spectral distribution and a second spectral distribution according to an embodiment of the present invention. As depicted in FIG. 1*a-c*, a light emitting diode, LED, filament lamp 100, providing LED filament lamp light 101 comprises at least one LED filament 102, at least one further LED 105, an at least partly transmissive envelope 107, and an optical element 108. The at least one LED filament 102 comprises a carrier 103 which has an elongated body and a plurality of LEDs 104 which are mechanically coupled to the carrier 103. The at least one LED filament 102 is configured to emit LED filament light 104'. The LED filament light 104' has a first spectral distribution S1 with a first color point x1,y1 and a first correlated color temperature T1. The at least one further LED 105 is configured to emit further LED light 106 which has a second spectral distribution S2 with a second color point x2,y2. The at least one LED filament 102 and the at least one further LED 105 are at least partly enclosed by the at least partly transmissive envelope 107. The optical element 108 is arranged to collimate the further LED light 106 into collimated further LED light 109. The LED filament lamp light 101 is composed of the LED filament light 104' which has a first spatial distribution S'1 and the collimated further LED light 109 which has a second spatial distribution S'2. As depicted in FIG. 1*c*, the first spatial distribution S'1 is broader than the second spatial distribution S'2. As depicted in FIG. 1*d*, the first spectral distribution S1 and the second spectral distribution S2 are different. For example, S1 may be white light having a warm color temperature and S2 may be white light having a cold color temperature. One or more of (i) $x1/x2 \geq 1.1$, and (ii) $x1/x2 \geq 1.1$ and $y1/y2 \geq 1.1$ with $x1/x2 \geq y1/y2$ applies. The LED filament lamp may further comprise a cap 112 and a driver (not shown). The plurality of LEDs may be connected via an electrically conductive track or patter or wire 110. The at least partly transmissive envelope 107 may consist of two or more parts. A first at least partly transmissive envelope part may be transmissive, a second at least partly transmissive envelope (124) part may be non-transmissive. The second part may be a housing. The housing may comprise the at least one further LED 105. As depicted in FIG. 1*a*, the optical element 108 may be a reflector 111 which has a light exit 123. The reflector 111 screens the at least one further LED 105 at a screening angle (a).

Figure 2:
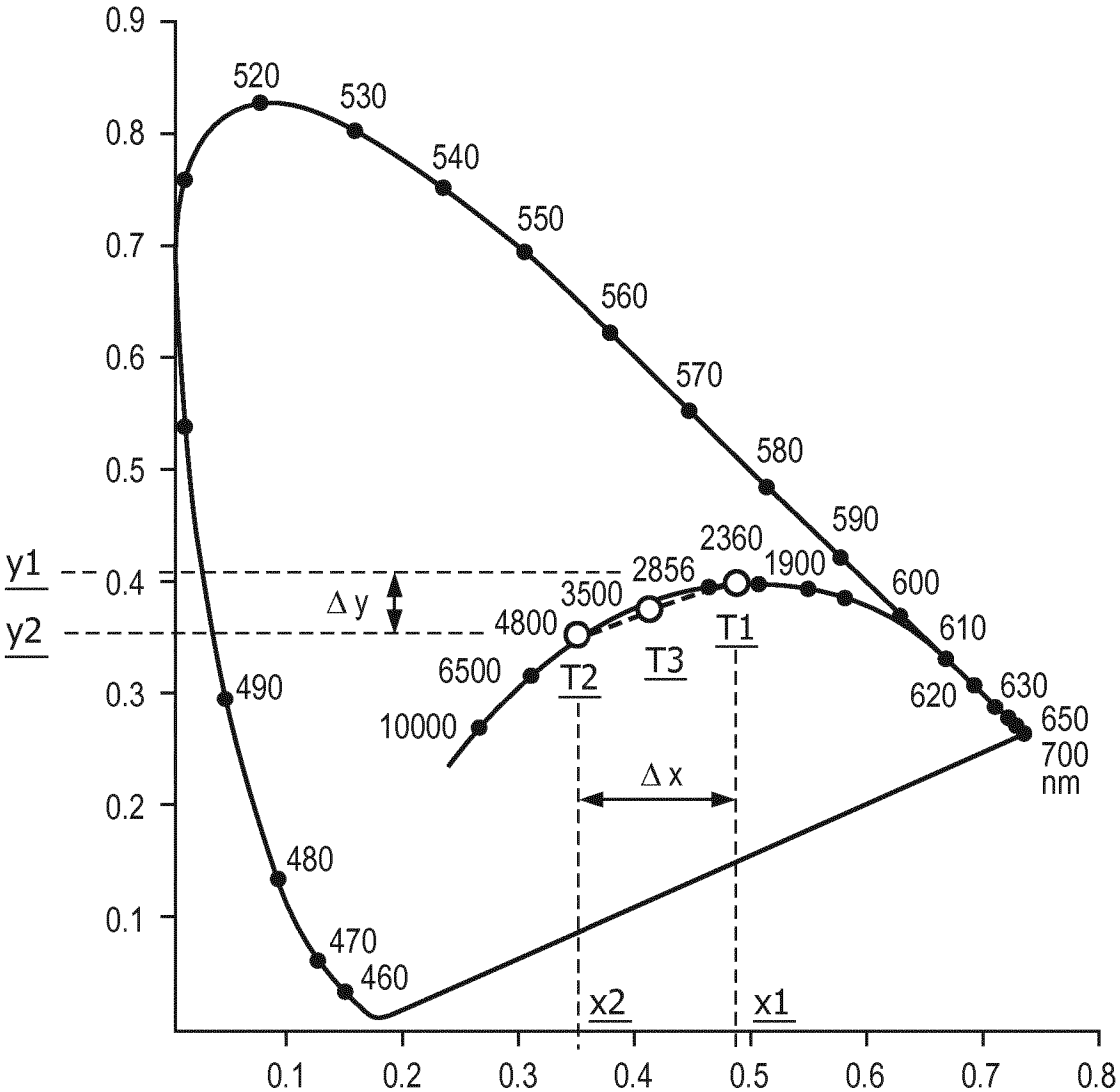
FIG. 2 shows a correlated color diagram according to an embodiment of the present invention.

FIG. 2 shows a correlated color diagram according to an embodiment of the present invention. The further LED light 106 may have a second correlated color temperature T2, wherein $T1/T2<0.9$ applies. As depicted in FIG. 2, adding collimated further LED light 106 which has a second correlated color temperature T2 to LED filament light 104', said LED filament light 104' has a first correlated color temperature T1, results in combined light which has a correlated color temperature T3. The correlated color temperature T3 is located between the correlated color temperature T1 and the correlated color temperature T2 on the black body line (BBL) or close to the BBL. The first color temperature T1 may be lower than 2650 K and the second color temperature T2 may be higher than 2950 K.

Figure 3:
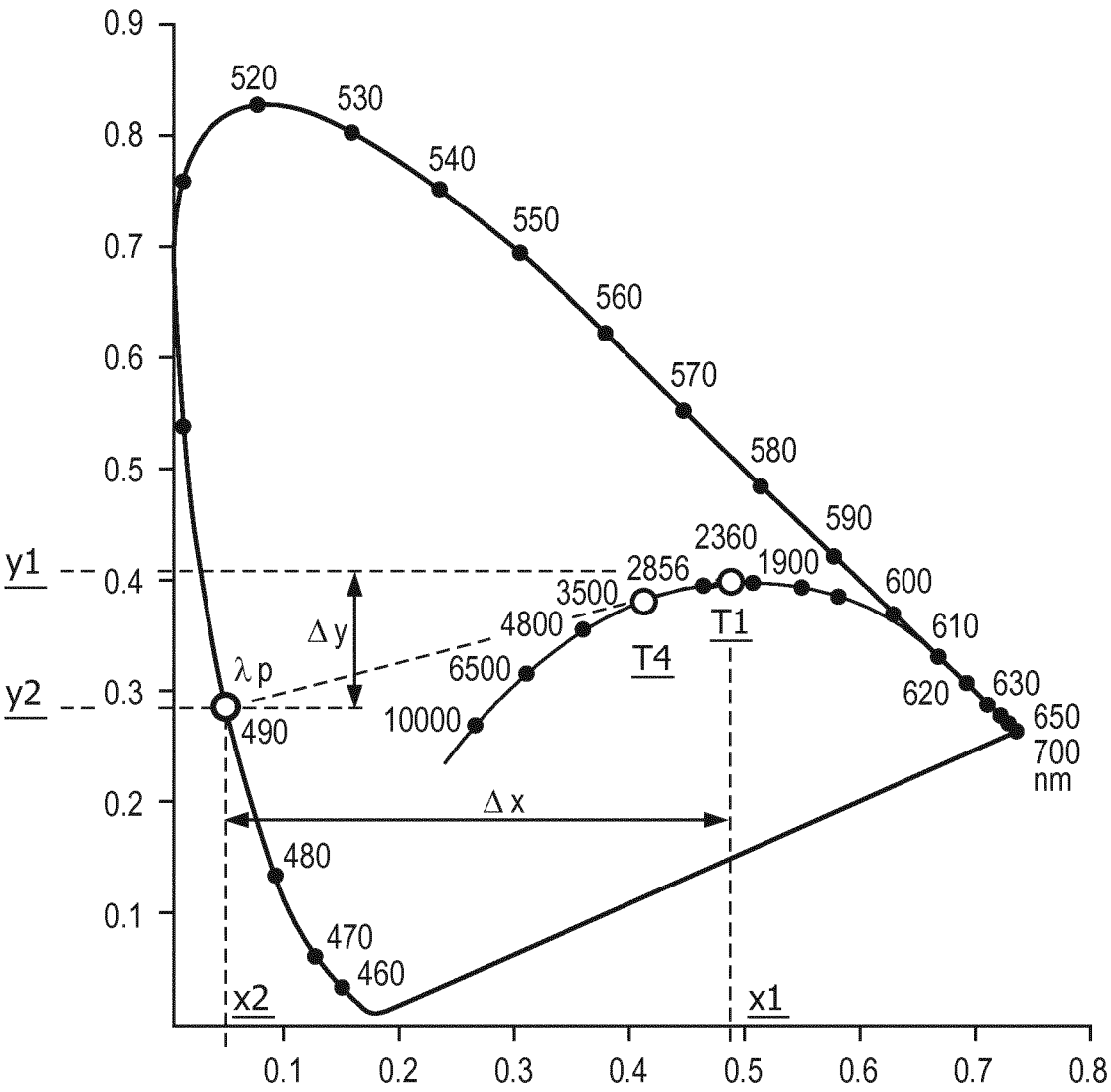
FIG. 3 shows a correlated color diagram according to an embodiment of the present invention.

FIG. 3 shows a correlated color diagram according to an embodiment of the present invention. The LED filament light 104' has a relatively low correlated color temperature T1 and the further LED light 106 may have a dominant wavelength (λd) in a range from 420 to 500 nm. Adding further LED light which has a dominant wavelength (λd) in a range from 420 to 500 nm shift the correlated color temperature T1 to a correlated color temperature T4 on the black body line (BBL) or close to the BBL. The correlated color temperature T4 has a higher color temperature than the correlated color temperature T1.

Figure 4B:
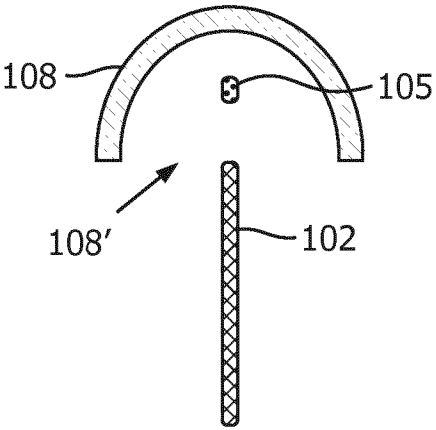
FIGS. 4*a* and *b* show schematic views of example arrangements a LED filament, a further LED and a reflector according to an embodiment of the present invention.
Figure 4A:
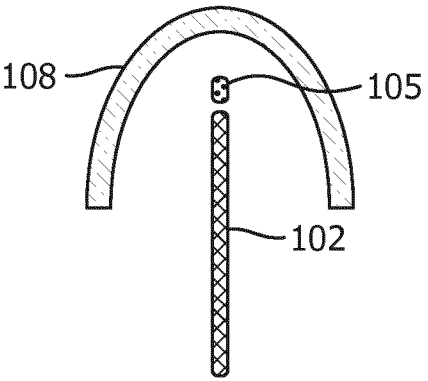

FIGS. 4*a* and *b* show schematic views of a LED filament and a reflector according to an embodiment of the present invention. As depicted in FIG. 4*a*, the at least one LED filament 102 is partly arranged outside optical element 108. As depicted in FIG. 4*b*, the at least one LED filament 102 is arranged completely outside said optical element 108. The at least one further LED 105 is arranged further inside a cavity 108' formed by the concavely shaped optical element 108.

Figure 5:
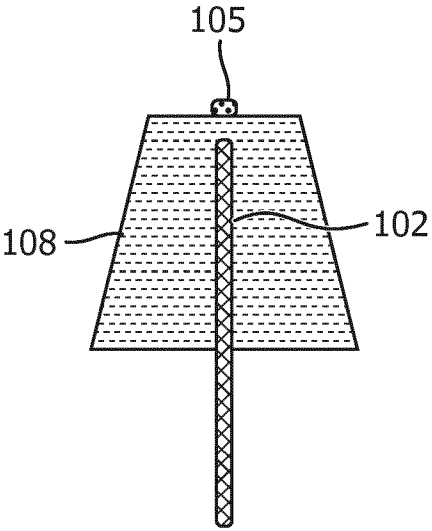
FIG. 5 shows a schematic view of a LED filament, a further LED and a refractive collimator according to an embodiment of the present invention.

FIG. 5 shows a schematic view of a LED filament and a refractive collimator according to an embodiment of the present invention. As depicted in FIG. 5, the at least one LED filament may be positioned partly outside a refractive collimator. The least one LED filament may also be positioned fully outside a refractive collimator.

Figure 6:
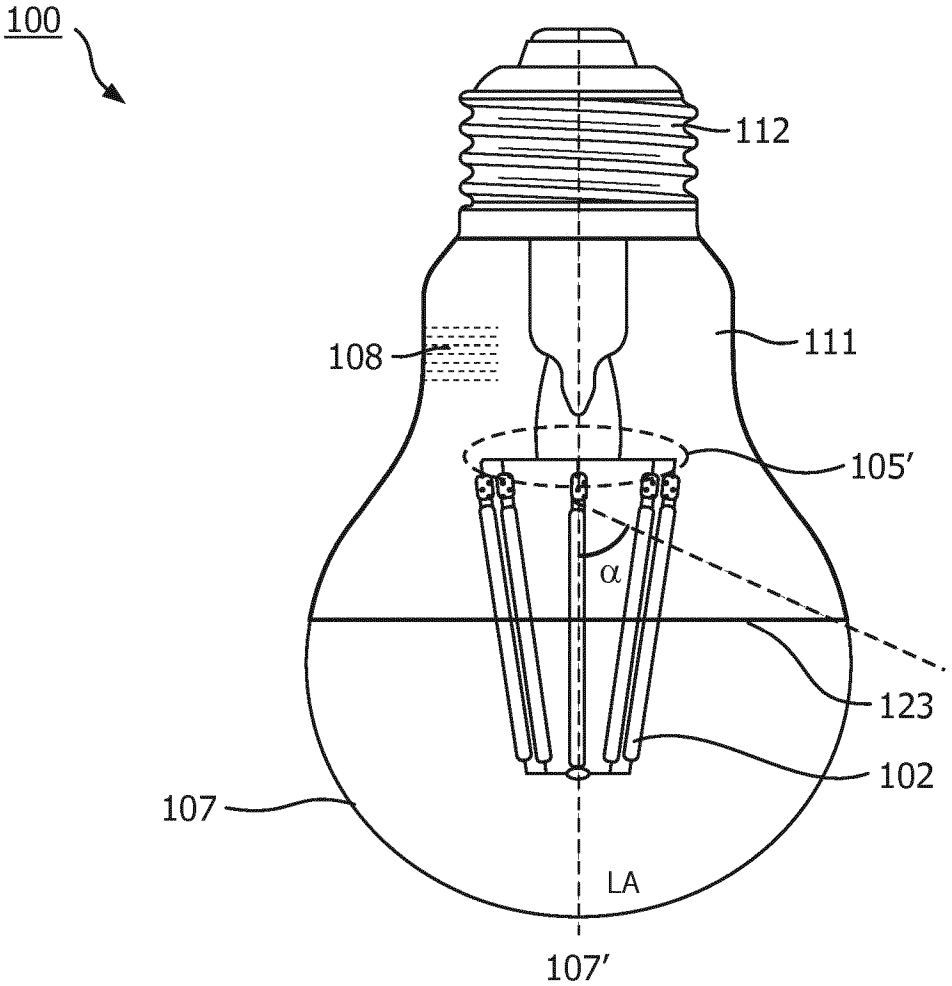
FIG. 6 shows a schematic view of a LED filament lamp according to an embodiment of the present invention.

FIG. 6 shows a schematic view of a LED filament lamp according to an embodiment of the present invention. As depicted in FIG. 6, the optical element 108 is a reflector 111. The reflector 111 is arranged as a concave reflector on a part of the at least partly transmissive envelope 107. The at least one further LED 105 is arranged at a position indicated with 105'.

As depicted in FIG. 6 and FIG. 1, the reflector 111 screens the at least one further LED 105 at a screening angle (a) higher than 65 degrees with respect to the longitudinal axis LA of the LED filament lamp 100 extending through a top 107' of the lamp envelope and lamp cap 112. As depicted in FIG. 6, the optical element 108 may be a reflector 111 which has a light exit 123.

Figure 7:
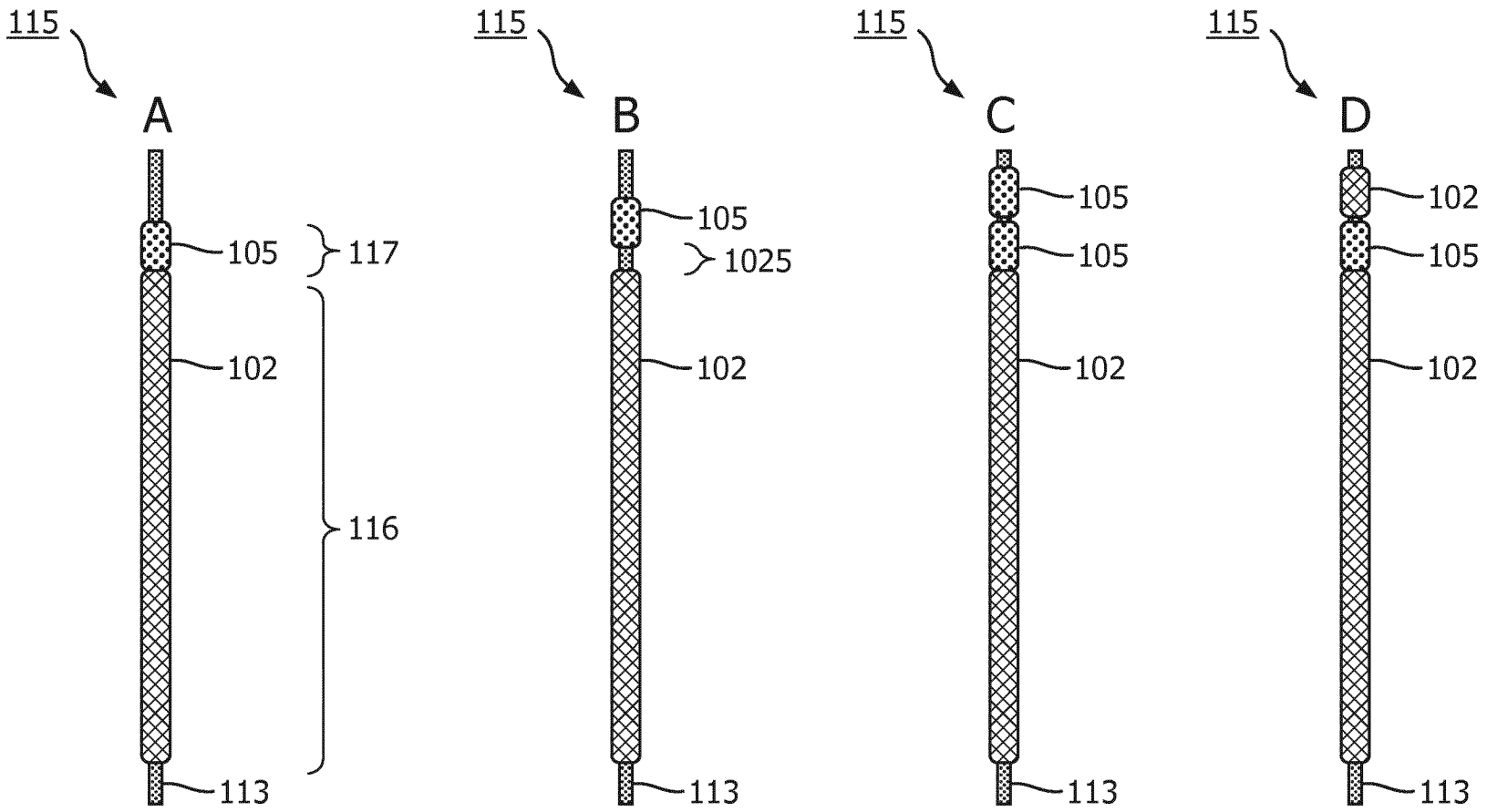
FIG. 7*a-d* show schematics views of lamp filaments according to an embodiment of the present invention.

FIG. 7*a-d* show schematics views of lamp filaments 115 according to an embodiment of the present invention. The LED filament lamp 100 may comprise at least one lamp filament 115. As depicted in FIG. 7*a*, the at least one lamp filament 115 comprises the at least one LED filament 102 and the at least one further LED 105. As depicted in FIG. 7*b*, there may be a gap or space 1025 between the at least one LED filament 102 and the at least one further LED 105. As depicted in FIG. 7*c*, the lamp filament 115 may comprise more than one further LED 105 such as for example two further LEDs 105. As depicted in FIG. 7*d*, the lamp filament 115 may comprise more than one LED filament 102 such as for example two LED filaments 102.

As depicted in FIG. 7*a-d*, the at least one lamp filament 115 comprising a base portion 116 and a top portion 117, the base portion 116 and the top portion 117 are different, wherein the top portion 117 comprises the at least one further LED 105 and the base portion 116 comprises the at least one LED filament 102. The top portion 117 may be arranged more recessed inside the optical component 108 (see e.g. FIG. 1*a*) than the base portion 116. The optical component may be a refractive element such as for example a total internal reflection (TIR) collimator.

Figure 8B:
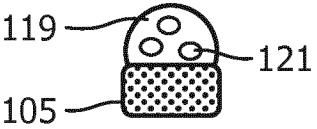
FIG. 8*a-b* show schematic views of a cross-section of a LED filament and a further LED according to an embodiment of the present invention.
Figure 8A:
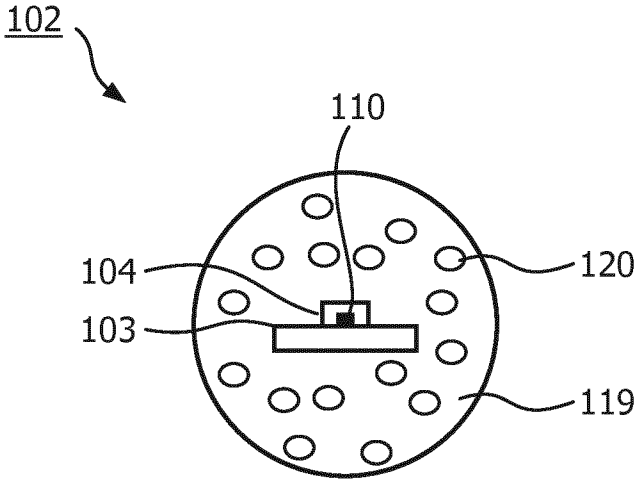

FIG. 8*a-b* show schematic views of a cross-section of a LED filament 102 and a further LED 105 according to an embodiment of the present invention. As depicted in FIG. 8*a*, the at least one LED filament 102 comprises an encapsulant 119 at least partially enclosing the plurality of LEDs 104, wherein the encapsulant 119 comprises a first luminescent material 120. The plurality of LEDs 104 emits LED light. The LED light may be converted to converted light. The LED filament light 104' comprises the LED light and/or converted light. As depicted in FIG. 8*b*, the at least one further LED 105 may comprise an encapsulant 119 at least partially enclosing the at least one further LED 105, wherein the encapsulant 119 comprises a second luminescent material 121. At least one of (i) the thickness of the encapsulant, (ii) the concentration of the first luminescent material (120), and (iii) the type of the luminescent material of the first luminescent material 120 and the second luminescent material 121 are different. The first luminescent material 120 and second luminescent material 121 may be the same while only their concentration and/or thickness of the encapsulant differs.

Figure 9:
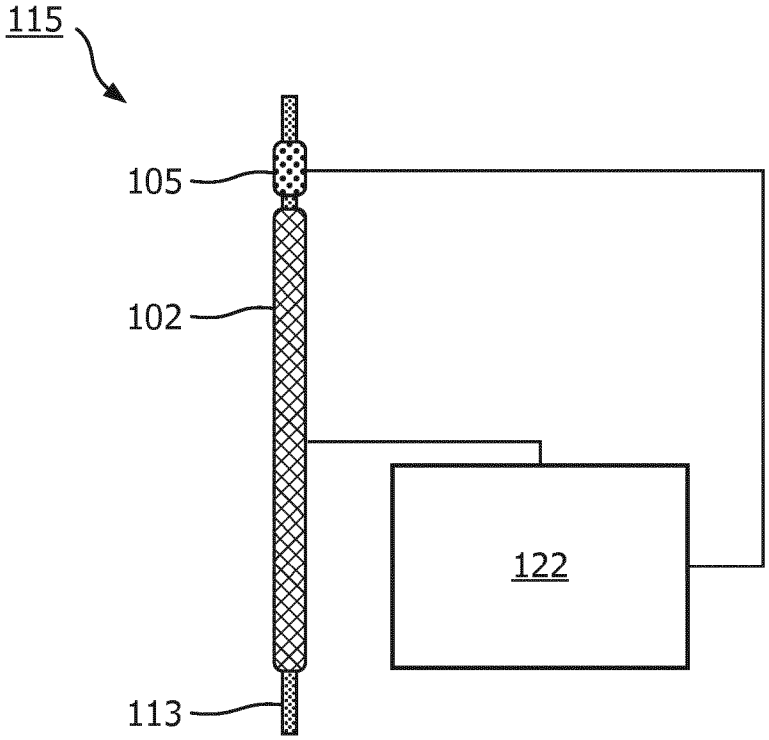
FIG. 9 shows a schematic view a LED filament lamp and a control unit according to an embodiment of the present invention.

FIG. 9 shows a schematic view a LED filament lamp and a control unit according to an embodiment of the present invention. As depicted in FIG. 9, the LED filament lamp may further comprise a control unit 122 which is electrically connected to the at least one LED filament 102 and the at least one further LED 105 for separately controlling the amount of LED filament light 104' and further LED light 105.

Figure 10:
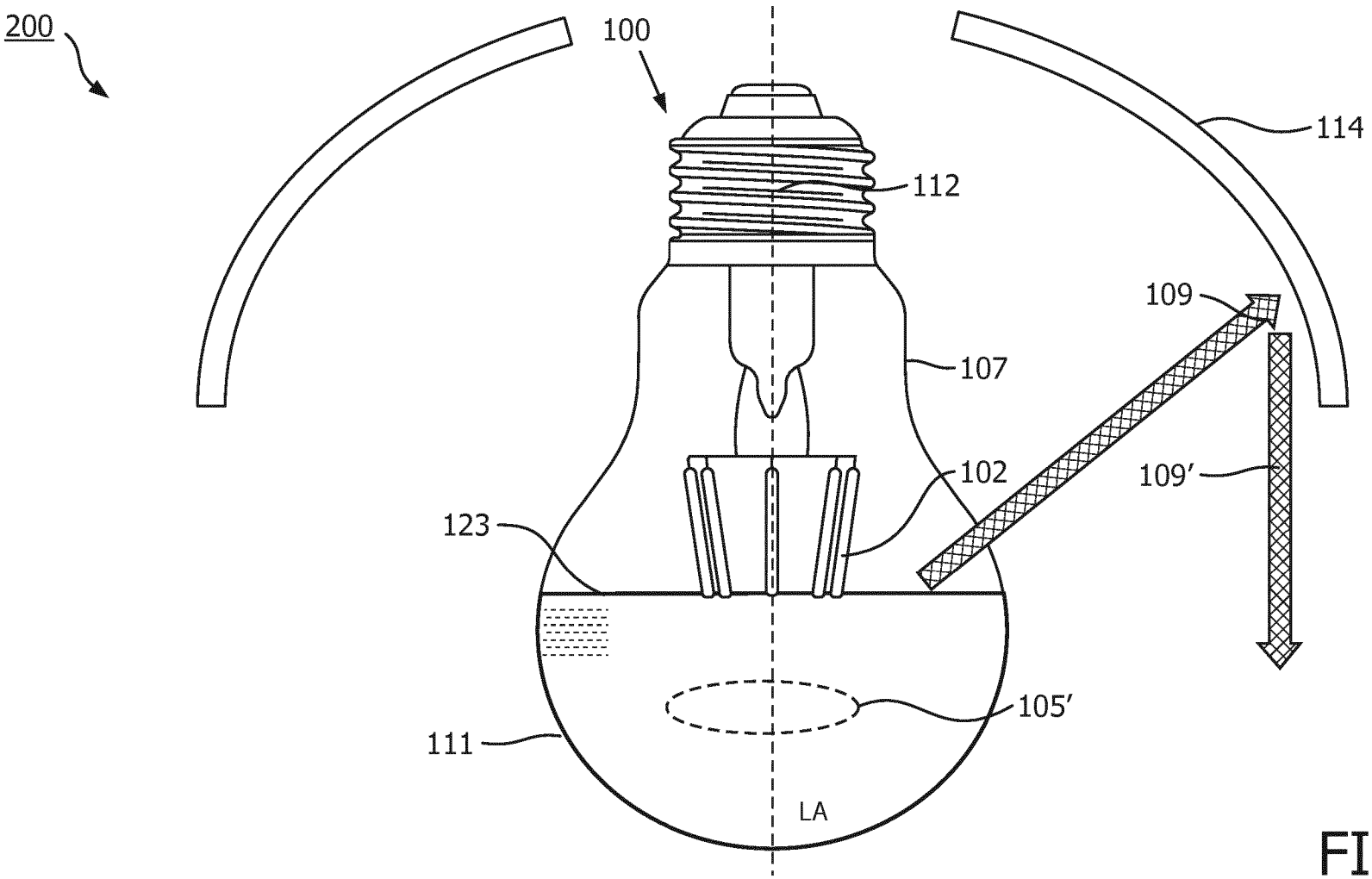
FIG. 10 shows a schematic view a LED filament lamp in a luminaire according to an embodiment of the present invention.

FIG. 10 shows a schematic view a LED filament lamp 100 in a luminaire 200 according to an embodiment of the present invention. A luminaire 200 comprises the LED filament lamp 100. In case of a luminaire with a lamp shade 114, the reflector 111 may be positioned with the light exit 123 directed towards the cap 112. The at least one LED filament 102 is partly arranged in the reflector 111. The at least one further LED 105 is arranged at a position indicated with 105'. The LED filament lamp 100 may have a cap 112 and a driver (not shown). The driver may be arranged in the cap 112 or in the envelope 107. Further LED light is collimated by the reflector 111 into collimated further LED light 109. The collimated further LED light 109 is reflected by a lamp shade 114 such that the reflected collimated further LED light 109' is for example directed to the table or floor (not shown).

The light emitting diode may also be a laser diode.

The visible wavelength range is in the range from 400 to 800 nm.

The terms "variable wavelength dependent light absorption" and "non-uniform light absorption" refers to that the degree of light absorption is (significantly) different for at least two different wavelengths or wavelength ranges of the visible light. Significant means that for at least two different wavelengths or wavelength ranges there is a difference in absorption of at least 10%, or at least 20%, or at least 30%.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species". Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A light emitting diode, LED, filament lamp, providing LED filament lamp light, the LED filament lamp comprising:

at least one LED filament comprising a carrier having an elongated body and a plurality of LEDs mechanically coupled to the carrier, the at least one LED filament is configured to emit LED filament light, the LED filament light having a first spectral distribution S1 with a first color point x1,y1 and a first correlated color temperature T1;

at least one further LED configured to emit further LED light having a second spectral distribution S2 with a second color point x2,y2;

an at least partly transmissive envelope, the at least one LED filament and the at least one further LED are at least partly enclosed by the at least partly transmissive envelope;

an optical element arranged for collimating the further LED light into collimated further LED light;

the LED filament lamp light is composed of the LED filament light having a first spatial distribution and the collimated further LED light having a second spatial distribution;

wherein the first spatial distribution is broader than the second spatial distribution;

wherein the first spectral distribution S1 and the second spectral distribution S2 are different; and wherein one or more of (i) $x1/x2 \geq 1.1$, and (ii) $x1/x2 \geq 1.1$ and $y1/y2 \geq 1.1$ with $x1/x2 \geq y1/y2$ applies;

the LED filament lamp comprising at least one lamp filament, the at least one lamp filament comprising the at least one LED filament and the at least one further LED.

2. The LED filament lamp according to claim 1, wherein the collimated further LED light having a second correlated color temperature T2, wherein $T1/T2 \leq 0.9$ applies.

3. The LED filament lamp according to claim 2, wherein the first color temperature T1 is lower than 2650 K and the second color temperature T2 is higher than 2950 K.

4. The LED filament lamp according to claim 1, wherein the further LED light having a dominant wavelength in a range from 420 to 500 nm.

5. The LED filament lamp according to claim 1, wherein the at least one LED filament is at least partly arranged outside said optical element.

6. The LED filament lamp according to claim 1, wherein the at least one further LED is arranged further inside a cavity formed by the optical element.

7. The LED filament lamp according to claim 1, wherein the optical element is a reflector.

8. The LED filament lamp according to claim 7, wherein the reflector is arranged as a concave reflector on a part of the at least partly transmissive envelope.

9. The LED filament lamp according to claim 7, wherein the reflector screens the at least one further LED at a screening angle ($\alpha$) higher than 65 degrees with respect to the longitudinal axis (LA) of the LED filament lamp.

10. The LED filament lamp according to claim 1, wherein there is a gap or space 1025 between the at least one LED filament 102 and the at least one further LED 105.

11. The LED filament lamp according to claim 1, wherein the at least one lamp filament comprising a base portion and a top portion, wherein the top portion comprises the at least one further LED and the base portion comprises the at least one LED filament, wherein the top portion is arranged more recessed inside the optical component than the base portion.

12. The LED filament lamp according to claim 1, wherein the at least one LED filament comprises an encapsulant at least partially enclosing the plurality of LEDs, wherein the encapsulant comprises a first luminescent material.

13. The LED filament lamp according to claim 12, wherein the at least one further LED comprises an encapsulant at least partially enclosing the at least one further LED, wherein the encapsulant comprises a second luminescent material, wherein at least one of (i) thickness, (ii) concentration, and (iii) type of the luminescent material of the first luminescent material and the second luminescent material are different.

14. The LED filament lamp according to claim 1, further comprising a control unit electrically connected to the at least one LED filament and the at least one further LED for separately controlling the amount of LED filament light and further LED light.

15. A luminaire comprising the LED filament lamp according to claim 1.

* * * * *